US005778697A

United States Patent [19]

Wantuck

[11] Patent Number: 5,778,697

[45] Date of Patent: Jul. 14, 1998

[54] ACCUMULATOR FOR REFRIGERATION SYSTEM

[75] Inventor: Gary Wantuck, Farmington Hills, Mich.

[73] Assignee: Parker-Hannifin Corporation, Cleveland, Ohio

[21] Appl. No.: 616,864

[22] Filed: Mar. 15, 1996

[51] Int. Cl.[6] ..... F25B 43/02

[52] U.S. Cl. ..... 62/503; 62/471

[58] Field of Search ..... 62/503, 512, 509, 62/474, 470, 471

[56] References Cited

U.S. PATENT DOCUMENTS

| | | | |
|---|---|---|---|
| 2,691,873 | 10/1954 | Skoli et al. . | |
| 2,953,906 | 9/1960 | Quick | 62/503 |
| 3,012,414 | 12/1961 | LaPorte . | |
| 3,177,680 | 4/1965 | Rasovich et al. . | |
| 3,370,440 | 2/1968 | Kellie . | |
| 3,643,465 | 2/1972 | Bottum . | |
| 3,798,921 | 3/1974 | Scherer et al. . | |
| 3,837,177 | 9/1974 | Rockwell et al. . | |
| 3,872,689 | 3/1975 | Bottum . | |
| 4,111,005 | 9/1978 | Livesay . | |
| 4,142,380 | 3/1979 | Dhyr et al. . | |
| 4,182,136 | 1/1980 | Morse . | |
| 4,199,960 | 4/1980 | Adams et al. . | |
| 4,291,548 | 9/1981 | Livesay . | |
| 4,331,001 | 5/1982 | Jones . | |
| 4,474,035 | 10/1984 | Amin et al. . | |
| 4,583,377 | 4/1986 | Viegas . | |
| 4,619,673 | 10/1986 | Cullen et al. . | |
| 4,675,971 | 6/1987 | Masserang . | |
| 4,768,355 | 9/1988 | Breuhan et al. | 62/503 |
| 4,866,951 | 9/1989 | Masterson, II . | |
| 4,938,037 | 7/1990 | Carlisle, Jr. . | |
| 5,184,479 | 2/1993 | Koberstein et al. . | |
| 5,201,792 | 4/1993 | Study . | |
| 5,282,370 | 2/1994 | Kiblawi et al. | 62/503 |

FOREIGN PATENT DOCUMENTS

| | | |
|---|---|---|
| 3545-013-A | 12/1986 | Germany . |

*Primary Examiner*—Harry B. Tanner
*Attorney, Agent, or Firm*—Christopher H. Hunter

[57] ABSTRACT

An accumulator includes an axial lower region for the accumulation of liquid refrigerant and an axial upper region for the accumulation of vapor refrigerant. A desiccant bag is disposed within the accumulator for removing moisture in the refrigerant. A U or J-shaped return tube in the accumulator has a lower most portion close to the lower end wall of the accumulator. An oil inlet tube and screen assembly is connected to the return tube at the lower most portion of the return tube. A first end of the oil inlet tube is received within an orifice formed in the bottom of the return tube, while the second end of the oil inlet tube extends axially downwardly toward the lower end wall of the accumulator. A screen assembly surrounds the oil inlet tube to prevent particles from entering the return conduit. The oil inlet tube draws oil practically down to the lower end wall of the accumulator for return to the refrigeration system.

26 Claims, 1 Drawing Sheet

ACCUMULATOR FOR REFRIGERATION SYSTEM

FIELD OF THE INVENTION

This invention relates generally to refrigeration systems, and specifically to an improved accumulator for refrigeration systems.

BACKGROUND OF THE INVENTION

Conventional refrigeration systems include a compressor, a condenser, an expansion device, and an evaporator. Refrigerant is circulated through the system to produce cooling. Energy is provided to the system by the compressor which serves to create a source of high pressure gas refrigerant which is allowed to pass through the condenser. The refrigerant dissipates heat in the condenser and changes state to a high pressure liquid. The refrigerant then passes through the expansion device and into the evaporator where the refrigerant changes state from a high pressure liquid to a low pressure liquid, and subsequently to a low pressure gas. The change of state removes heat from the area surrounding the evaporator. The refrigerant is then drawn from the evaporator back to the compressor in a low pressure gas form, where it is again compressed into high pressure gas for repetition of the cycle.

An accumulator is also normally located between the evaporator and the compressor in the refrigeration system. The accumulator ensures that only refrigerant in a vapor stage passes on to the compressor, as refrigerant from the outlet of the evaporator typically includes both a liquid component and a vapor component. In some accumulators, the vapor component is collected in the upper region of the accumulator, while the liquid component, along with any lubricating oil, drains to the lower region of the accumulator. The vapor component of the refrigerant is removed from the upper region of the accumulator by a U-shaped or J-shaped return conduit. The return conduit typically includes a metering device which draws a small amount of oil in the liquid refrigerant back into the return tube for lubrication of the downstream components, e.g., the compressor.

Applicants believe that in the past, the metering device for the return tube has typically comprised an opening located toward the lower, curved end of the return tube and a screen assembly covering the opening to prevent particles from passing into the return tube. This type of metering device is shown in U.S. Pat. Nos. 4,615,971; 4,291,548; 3,872,689; 4,938,037; 4,111,005; 4,199,960; and 3,837,177. Certain of these patents, and in particular, U.S. Pat. Nos. 3,837,177; 3,872,689; and 4,938,037 disclose to provide the opening in the bottom of the return conduit, that is, facing the lower end wall of the accumulator, while other patents disclose to provide the opening along the side of the return conduit. In either case, it is believed that some space is left between the opening and the lower end of the accumulator for oil to collect without being drawn into the return conduit.

Certain metering devices have also incorporated a combination oil inlet tube and screen assembly, wherein the oil inlet tube extends through an opening formed in the side of the return conduit. The oil inlet tube extends somewhat horizontally away from the return conduit. This design is shown in U.S. Pat. Nos. 3,012,414; 5,201,792; 5,184,479; 4,474,035; and 4,866,951. These accumulators suffer from the same drawback described above, i.e., allowing a certain amount of oil to accumulate in the lower region of the accumulator without being drawn into the return conduit.

Finally, while U.S. Pat. No. 4,182,136 discloses a short oil inlet tube extending downwardly from the return conduit (that is, toward the lower end wall of the accumulator), the tube is shown as being formed in one piece with the return conduit, which increases the manufacturing steps and labor associated with the return conduit. Additionally, this patent does not teach to provide a screen assembly around the oil inlet tube, which could therefore allow particles to enter the return conduit.

As such, it is believed there is a demand in the industry for an improved accumulator which prevents excess oil from collecting in the lower region of the accumulator.

SUMMARY OF THE INVENTION

The present invention provides an improved accumulator for a refrigeration system, and in particular provides an improved accumulator having a unique metering device which allows oil to be drawn into the return conduit of the accumulator practically to the bottom of the accumulator.

According to the principles of the present invention, the return conduit in the accumulator has an opening formed in the lower-most curved portion of the conduit. The opening faces downwardly toward the lower end wall of the accumulator. A combination oil inlet tube and screen assembly is connected to the return conduit at this lower-most portion, with the oil inlet tube having one end which is press-fit into the opening in the return conduit, and another end which is located proximate the lower end wall of the accumulator. The screen assembly includes a tubular portion surrounding the inlet tube and a bracket to fixedly secure the screen assembly and the inlet tube to the return conduit. An upper end cap on the bracket encloses the upper end of the tubular screen, while a lower end cap on the bracket encloses the lower end of the tubular screen, and is supported on the lower end wall of the accumulator.

The oil inlet tube and screen assembly is easy to assemble on the return conduit, and the downwardly-extending inlet tube draws oil practically to the bottom of the accumulator.

Further features and advantages of the present invention will be apparent upon reviewing the following detailed description and accompanying drawings.

DETAILED DESCRIPTION OF THE PREFERRED EMBODIMENT

Figure 1:
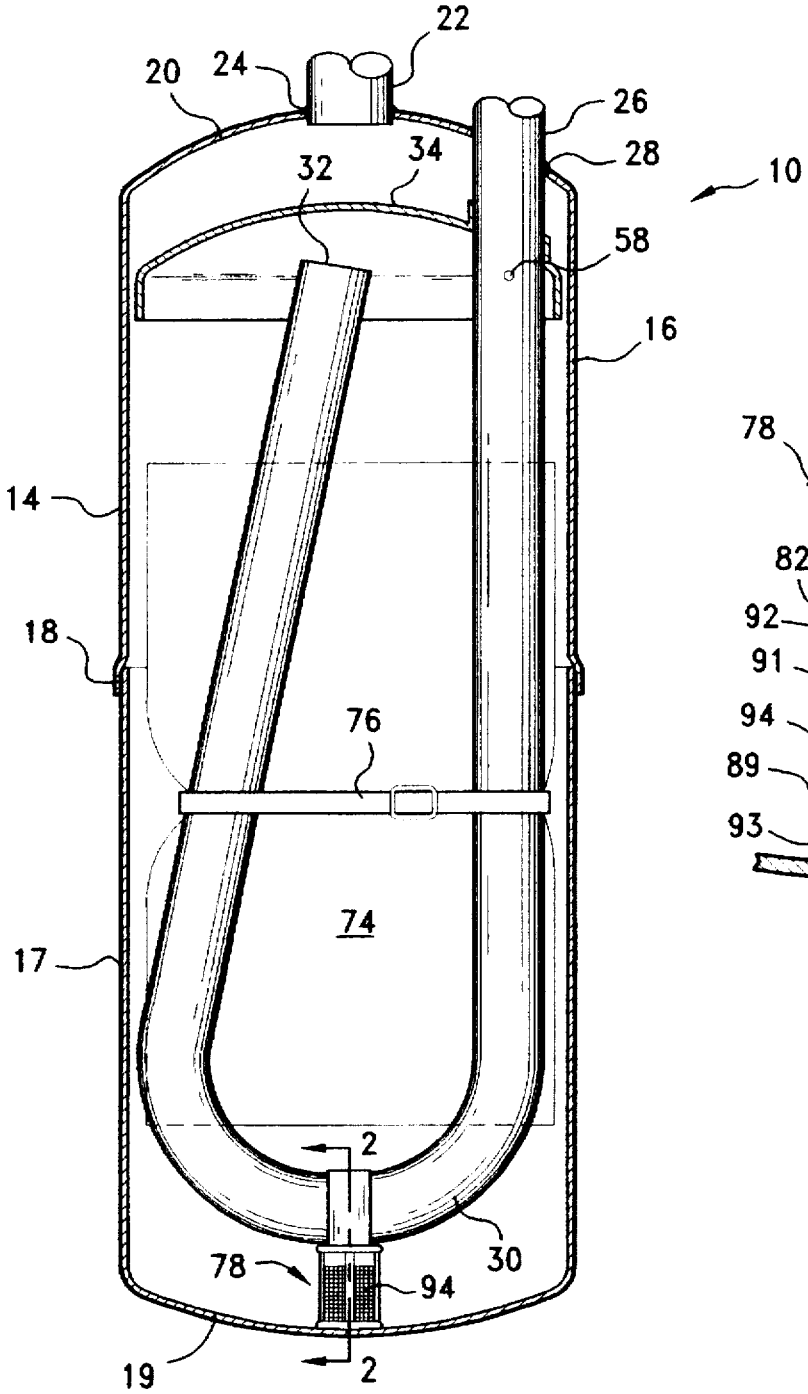
FIG. 1 is a side perspective view of an accumulator constructed according to the principles of the present invention.

Referring to the drawings, an accumulator constructed according to the principles of the present invention is indicated generally at 10. The accumulator includes an outer housing 14 having an axially upper region 16 and an axially lower region 17, which together define a reservoir for refrigerant. The upper region and lower region are preferably joined together in abutting relationship by an overlapping welded juncture 18. The lower region of the accumulator is closed by a lower end wall 19, while the upper region of the accumulator is closed by an upper end wall 20. Housing 14 is preferably cylindrical in shape, while the lower and upper end walls 19, 20 preferably have a domed or inwardly-concave shape. A refrigerant inlet tube 22 is received within an opening formed in the center of upper end wall 20 and is secured thereto by, e.g., brazing at 24. A refrigerant return conduit 26 extends through another opening in the upper end wall 20 adjacent inlet tube 22, and is also attached to the end wall by, e.g., brazing at 28, to provide a pressure seal and a permanent juncture with the wall 20.

Return conduit 26 extends vertically within the accumulator along the side wall of the upper region 16 and lower region 17 and is curved in a U or J-shaped design at its lower-most portion 30, the curved portion being located close to the lower end wall 19 of the accumulator. The return conduit extends upwardly from the curved portion 30 to an inlet end 32. The inlet of the return tube is located in the upper region of the accumulator, preferably within the interior of a domed baffle 34.

A small anti-syphon hole 58 is provided in the return conduit 26 to prevent undesired syphoning of liquid under gravity from the interior of the accumulator to portions of the system located at a lower level of the accumulator.

A desiccant bag 74 is also located in the accumulator and secured to the return conduit 26 by strap 76. Desiccant 74 adsorbs any water that may be present in the refrigerant passing through the accumulator.

It is noted that the structure described above for the accumulator is merely one example of an accumulator that can be used with the present invention. Such a structure is a preferred structure which is described in U.S. Pat. No. 4,474,035, which is incorporated herein by reference, although as should be apparent to those skilled in the art, accumulators having different structures could also be used with the present invention.

The operation of the present invention will be briefly described. In a refrigeration system, a compressor supplies vapor refrigerant under pressure to a condenser. The condenser changes the state of the compressed refrigerant to a liquid, and in the process heat is expelled to the surrounding region. The liquid refrigerant then passes through an expansion orifice to an evaporator. The expansion orifice lowers the pressure of the refrigerant and the evaporator causes the refrigerant to change its state from a liquid to a gas, thereby absorbing heat from the surrounding region, although the vapor refrigerant also includes a liquid component after passing through the evaporator. At the outlet to the evaporator, the refrigerant, with liquid and vapor components, is directed through inlet tube 22 to the accumulator 10. The refrigerant is directed against dome 34 which causes the refrigerant to flow down the inside surface of accumulator housing 14, thereby separating the refrigerant into a vapor stage. The vapor refrigerant collects toward the upper region 16 of the accumulator, while the liquid refrigerant collects toward the lower region 17 of the accumulator. Dome 34 also prevents incoming refrigerant through inlet 22 from passing directly into the inlet end 32 of the return conduit. Water, oil and particles are also included in the refrigerant as it passes into the accumulator. The desiccant 74 absorbs moisture in the refrigerant, while the oil and particles collect with the liquid refrigerant in the lower region of the accumulator. The vapor refrigerant in the upper region of the accumulator is drawn through inlet end 32 of return conduit 26. The vapor refrigerant then passes through return conduit 26 back to the compressor in the refrigeration system.

Figure 2:
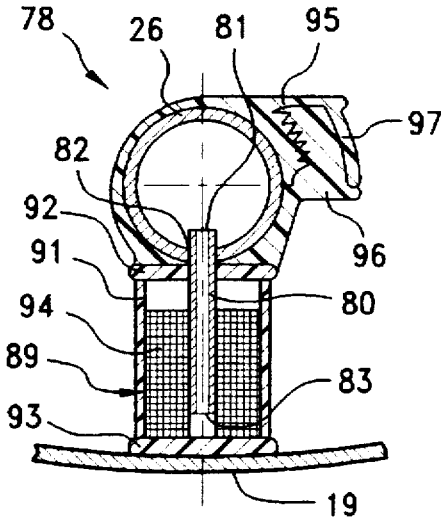
FIG. 2 is a cross-sectional side view of the oil inlet tube and screen assembly for the accumulator of FIG. 1.

According to the present invention, at the lower-most portion 30 of the return conduit 26, there is located a combination oil inlet tube and screen assembly, indicated generally at 78. As shown in FIG. 2, assembly 78 includes a vertically-extending oil inlet tube 80 extending downwardly from the lower-most portion 30 of the return tube. Oil inlet tube 80 has a first, upper end 81 which is received within an orifice 82 in return conduit 26. Orifice 82 is formed in the bottom side of the lower most portion 30 of return conduit 26, that is, orifice 82 faces axially downward from return conduit 26 toward the lower end wall 19 of the accumulator. The upper end 81 is secured within orifice 82 preferably by press fitting the tube 80 into orifice 82, although it could also be attached by other means such as by brazing. The second, lower end 83 of the oil inlet tube is located proximate the lower end wall 19 of the accumulator. The oil inlet tube is preferably straight.

To prevent particles from entering into oil inlet tube 80, the assembly also includes a tubular screen, indicated generally at 89 around tube 80. Screen 89 surrounds tube 80, and is supported by a frame or bracket 91. Bracket 91 has an upper annular end cap 92 at the upper end of the screen and a lower annular end cap 93 at the lower end of the screen. Supports 94 (see also FIG. 1) extend between the upper end cap 93 and lower end cap 94 for support of the bracket. Upper end cap 92 includes a central opening to receive tube 80 and is preferably located proximate return conduit 26, and extends substantially parallel to the longitudinal axis of the return conduit at this location. The bracket also includes a ratchet-type clasp 95 with opposing ratchet portion 96, 97 preferably integrally formed with upper end cap 92. Clasp 95 surrounds return conduit 26 to fixedly, yet removably, secure screen 89 to the return conduit. Finally, lower end cap 93 is disposed adjacent, and preferably in contacting relation with, the inside surface of lower wall 19, such that oil inlet tube 80 is as close as possible to lower end wall 19, while still providing space between lower end 83 of tube 80 and end cap 93 for fluid flow. While the oil inlet tube and screen assembly can be formed of any appropriate material, it is preferred that the screen 89 and bracket 91 are formed from plastic, and that the oil inlet tube 80 is formed from copper. The dimensions of the upper end 81 and lower end 83 of oil inlet tube 80, as well as the length of the oil inlet tube, can be chosen upon the particular fluid flow requirement. It is also pointed out that by having the oil inlet tube extend practically to the bottom of the accumulator, the return conduit can have its curved portion at a location which is further away from the lower end wall of the accumulator than typical prior art designs, which thus shortens the return conduit and saves material.

Oil which is collected along with the liquid refrigerant in the lower region 17 of the accumulator is drawn through oil inlet tube 80 into return conduit 26 to be mixed with vapor refrigerant and returned to the downstream components in the system. Screen 89 prevents any particles in the liquid refrigerant from passing into the return conduit 26.

Thus, as described above, the present invention provides a novel and unique accumulator, and in particular, a unique metering device for an accumulator which draws oil into the return conduit practically to the bottom of the accumulator. The metering device is also simple to assemble and attach to the return conduit of the accumulator.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An accumulator located in a refrigeration system at the outlet side of an evaporator, said refrigeration system introducing moisture, particle and oil contaminants into refrigerant flowing through the system and said refrigerant having liquid and vapor components at an outlet side of the evaporator, said accumulator comprising:

a refrigerant reservoir having a longitudinal axis oriented in a vertical plane, said reservoir having an enclosed interior with an axial lower region for the accumulation of liquid refrigerant and an axial upper region for the accumulation of vaporous refrigerant, an inlet port for directing liquid and vaporous refrigerant from the evaporator into the reservoir, and an outlet port for directing vapor refrigerant from the reservoir, desiccant disposed within said reservoir for removing the moisture from the refrigerant, a return conduit disposed within said reservoir for directing vapor refrigerant from the reservoir to said outlet port, said return conduit having an inlet end disposed toward the axial upper region of the reservoir and an outlet end fluidly connected to said outlet port, and an oil inlet tube and screen assembly connected to said return conduit for directing oil in the liquid refrigerant into the vapor refrigerant flow in the return conduit, said oil inlet tube having a first, outlet end connected to said return conduit, and a second, inlet end extending axially downward to a location proximate a lower end wall of the reservoir, said screen assembly surrounding said oil inlet tube and preventing particle contaminants from entering the inlet end of the oil inlet tube, said screen assembly supported against the return conduit.

2. The accumulator as in claim 1, wherein said return conduit includes an orifice, and said oil inlet tube is received within said orifice.

3. The accumulator as in claim 2, wherein said orifice of said return conduit faces axially downward toward the lower end wall of the reservoir, said oil inlet tube extending into said orifice.

4. The accumulator as in claim 3, wherein said oil inlet tube has a dimension which is press-fit within said downwardly-extending orifice in said return conduit.

5. The accumulator as in claim 4, wherein said screen assembly extends between said lower end wall of the reservoir and said return conduit.

6. The accumulator as in claim 5, wherein said screen assembly includes a tubular screen surrounding said oil inlet tube, a first annular end cap enclosing an axial upper end of said tubular screen and receiving said oil inlet tube through a central opening, and a second annular end cap enclosing an axial lower end of said screen and disposed against the lower end wall of the reservoir.

7. The accumulator as in claim 6, wherein supports extend between the first and second end caps.

8. The accumulator as in claim 7, wherein said first end cap is located against said return conduit.

9. The accumulator as in claim 8, further including a retaining device integral with said first end cap retaining said first end cap against said return conduit.

10. The accumulator as in claim 9, wherein said retaining device includes a clasp surrounding said return conduit.

11. The accumulator as in claim 10, wherein said clasp is integrally formed with said first end cap.

12. The accumulator as in claim 1, further including a retaining device integral with said screen assembly retaining said screen assembly against said return conduit.

13. The accumulator as in claim 12, wherein said retaining device includes a clasp surrounding said return conduit.

14. The accumulator as in claim 13, wherein said clasp is integrally formed with said first end cap.

15. The accumulator as in claim 14, wherein said screen assembly includes a tubular screen surrounding said oil inlet tube, a first annular end cap enclosing an axial upper end of said tubular screen and receiving said oil inlet tube through a central opening, and a second annular end cap enclosing an axial lower end of said screen.

16. The accumulator as in claim 15, wherein supports extend between the first and second end caps.

17. The accumulator as in claim 16 wherein said first end cap is located against said return conduit.

18. The accumulator as in claim 17, wherein said return conduit includes an orifice, and said oil inlet tube is received within said orifice.

19. The accumulator as in claim 18, wherein said orifice of said return conduit faces axially downward toward the lower end wall of the reservoir.

20. The accumulator as in claim 19, wherein said oil inlet tube has a dimension which is press-fit within said downwardly-extending orifice in said return conduit.

21. The accumulator as in claim 20, wherein said second annular end cap of said screen assembly is disposed against the lower end wall of the reservoir, and the screen assembly extends between said lower end wall of the reservoir and said return conduit.

22. An accumulator located in a refrigeration system at the outlet side of an evaporator, said refrigeration system introducing moisture, particle and oil contaminants into refrigerant flowing through the system and said refrigerant having liquid and vapor components at an outlet side of the evaporator, said accumulator comprising:

a refrigerant reservoir having a longitudinal axis oriented in a vertical plane, said reservoir having an enclosed interior with an axial lower region for the accumulation of liquid refrigerant and an axial upper region for the accumulation of vaporous refrigerant, an inlet port for directing liquid and vaporous refrigerant from the evaporator into the reservoir, and an outlet port for directing vapor refrigerant from the reservoir, desiccant disposed within said reservoir for removing the moisture from the refrigerant, a return conduit disposed within said reservoir for directing vapor refrigerant from the reservoir to said outlet port, said return conduit having an inlet end disposed toward the axial upper region of the reservoir, an outlet end fluidly connected to said outlet port, and a U-shaped lower portion disposed toward a lower end wall of the reservoir, said U-shaped lower portion having an orifice facing axially downward toward the lower end wall of the reservoir; and an oil inlet tube and screen assembly connected to said return conduit for directing oil in the liquid refrigerant into the vapor refrigerant flow in the return conduit, said oil inlet tube having a first outlet end received within said orifice in said return conduit, and a second, inlet end extending axially downward to a location proximate the lower end wall of the reservoir, said screen assembly surrounding said oil inlet tube and preventing particles from entering the inlet end of the oil inlet tube, said screen assembly including a screen surrounding said oil inlet tube, a first end cap at one end of the screen assembly retained against said return conduit, and a second end cap at another end of the screen assembly disposed adjacent the lower end wall of the reservoir.

23. The accumulator as in claim 22, further including a retaining device fixedly locating said first end cap against said return conduit.

24. The accumulator as in claim 23, wherein said retaining device includes a clasp surrounding said return conduit, and said first end cap is formed integrally with said clasp.

25. The accumulator as in claim 24, wherein said screen is tubular and said first end cap is disposed at one axial end of the screen and said second end cap is disposed at another axial end of the screen.

26. The accumulator as in claim 25, wherein said second end cap is disposed against the lower end wall of the reservoir.

* * * * *